US005765757A

United States Patent [19]

Bendall

[11] Patent Number: 5,765,757

[45] Date of Patent: Jun. 16, 1998

[54] QUICK SELECT NOZZLE SYSTEM

[75] Inventor: Albert R. Bendall, San Diego, Calif.

[73] Assignee: Hunter Industries Incorporated, San Marcos, Calif.

[21] Appl. No.: 572,314

[22] Filed: Dec. 14, 1995

[51] Int. Cl.[6] ..... B05B 15/10

[52] U.S. Cl. ..... 239/205; 239/242; 239/390; 239/394

[58] Field of Search ..... 239/237, 240, 239/241, 242, 246, 203, 204, 205, 206, DIG. 1, 390, 391, 392, 394, 436, 533.14

[56] References Cited

U.S. PATENT DOCUMENTS

| | | | |
|---|---|---|---|
| 4,501,391 | 2/1985 | Hunter | 239/97 |
| 4,773,595 | 9/1988 | Livne | 239/242 |
| 4,787,558 | 11/1988 | Sexton et al. | 239/205 |
| 4,919,337 | 4/1990 | Van Lecuwen et al. | 239/205 |
| 5,086,977 | 2/1992 | Kah, Jr. | 239/205 |
| 5,348,228 | 9/1994 | Wang | 239/394 |
| 5,423,486 | 6/1995 | Hunter | 239/205 |

*Primary Examiner*—Andres Kashnikow
*Assistant Examiner*—Lisa Ann Douglas
*Attorney, Agent, or Firm*—Baker, Maxham, Jester & Meador

[57] ABSTRACT

A sprinkler system for distributing water from a source substantially evenly over an area of terrain comprises a body defining a passage having an inlet connected to an outlet extending at an angle to the inlet, and a generally circular nozzle plate having a plurality of nozzles therein rotatably mounted at the outlet for selectively positioning a selected one of the plurality of nozzles in alignment with the outlet for distributing a stream of water outward from the housing, and the nozzle plate being selectively rotatable for selectively moving the nozzle plate to a selected nozzle position.

16 Claims, 3 Drawing Sheets

QUICK SELECT NOZZLE SYSTEM

BACKGROUND OF THE INVENTION

The present invention relates to irrigation systems and pertains particularly to an improved sprinkler unit having multiple selectable nozzles having selected ranges and areas of water distribution.

The artificial distribution of water through irrigation systems is in wide use throughout the world today. There are many irrigation systems utilized, with each having its own benefits and drawbacks.

One of the most widely used systems, particularly where water is not abundant or plentiful, is the sprinkler system wherein a plurality of sprinkler units are positioned about a land area for distributing water over the surface of the land area. Such systems are widely used for lawns, golf courses, playing fields and many field crops.

The typical sprinkler installation requires different arcs and spacings of sprinkler units to achieve optimum coverage. In the past this has required the use of several different types of sprinkler units. Interchangeable nozzles have recently come into use to enable different spacings and arcs of coverage for each type of sprinkler unit. However, this requires that the installer carry a supply of many different sprinkler nozzles.

It is also important for an installation to utilize a minimum number of controllers, valves, lines and sprinkler units to achieve a substantially uniform distribution of an optimum amount of water over a given area. A recently developed matched precipitation system as disclosed in co-pending application to be granted as U.S. Pat. No. 5,456,411 on Oct. 10, 1995, assigned to assignee hereof, solves major aspects of this problem. However, it still requires the installer to stock a number of different nozzles and selectively replace nozzles to achieve the desired spacing and coverage.

Also, the matching of nozzles for a given sprinkler system is time consuming and frequently requires complex calculations. Replaceable nozzles must be individually removed and replaced which can also require special tools and takes time.

Accordingly, it is desirable that a sprinkler system be available having a plurality of sprinkler nozzles that are readily selectable for providing selectable precipitation rate and coverage over a wide range of arcs and spacings.

SUMMARY AND OBJECTS OF THE INVENTION

Accordingly, it is a primary object of the present invention to provide an improved sprinkler system having selectable nozzles that are readily selectable for providing selectable coverage over a wide range of arcs and spacings.

In accordance with the primary aspect of the present invention, a sprinkler system comprises sprinkler units having a multiple nozzle rotor that is selectively rotatable for providing a wide range of selectable precipitation rates for matching different arcs and spacings of coverage.

A sprinkler unit having a plurality of nozzles for a wide range of conditions, comprises a housing having an inlet, an outlet and a passage connecting said inlet to said outlet and means for connecting said inlet to a source of water, a nozzle plate having a plurality of nozzles therein rotatably mounted at said outlet for selectively positioning a selected one of said plurality of nozzles in alignment with said outlet for distributing a stream of water outward from said housing, and said nozzle plate having means extending to a top of said housing for selectively moving said nozzle plate to a selected position.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Figure 1:
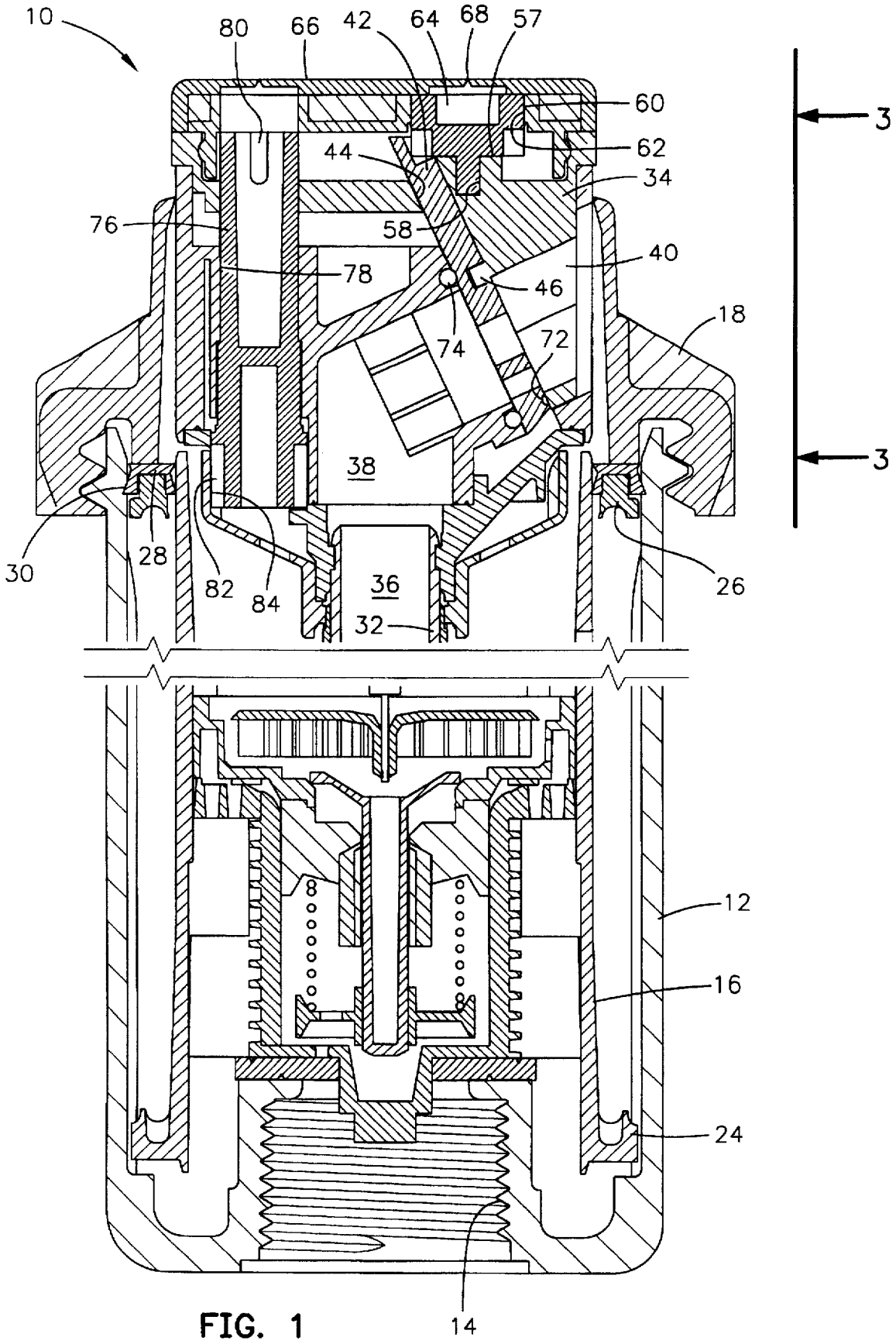
FIG. 1 is a side elevation view in section of a sprinkler unit embodying, a preferred embodiment of the invention.

Referring to the drawings, particularly to FIGS. 1 there is shown a side elevation view of a sprinkler unit embodying the present invention. This sprinkler unit is of the type represented and disclosed for example in U.S. Pat. No. 4,568,024, entitled "Oscillating Sprinkler", granted Feb. 4, 1986 to the assignee of the subject application, said patent being incorporated herein by reference as though fully set forth. The sprinkler unit is turbine driven through a gear train that is reversible and has an adjustable arc. Certain units may be made full circle with or without a reversing drive. Others are variable arc form forty degrees up to about three-hundred sixty degrees.

A primary aspect of the present invention comprises a selective nozzle system wherein a system of nozzles are provided with means for selectively positioning a selected nozzle at the unit outlet to obtain a desired coverage or precipitation rate for various arcs and ranges for the sprinkler unit. The sprinkler unit, designated generally by the numeral 10, is preferably of the retractable pop-up type which is normally mounted within a housing below ground surface and pops up when water is supplied for operation. However, the nozzle system of the present invention can be mounted in a fixed non-retractable unit and in rotating and oscillating systems.

The sprinkler unit, as illustrated, comprises a generally tubular fixed outer housing 12 having an inlet at 14 for connecting to a riser of a source of pressurized water. An inner housing 16 is telescopically mounted within the outer fixed housing 12 and is retained in position by means of a retaining cap 18 threadably mounted at the upper end of the housing 12 by complementary threads 20 and 22. A retracting spring (not shown) is captured between annular rim or shoulder 24 at the lower end of inner housing 16 and an annular retainer 26 at the upper end biased against an annular seal 28 and a shoulder 30 of the retaining cap 18 the inner housing is normally biased to a retracted position in the outer housing. Upon the application of water pressure, the inner housing telescopically extends axially upward from the outer housing.

A reversible turbine drive assembly including a gear train (not shown) is mounted within the inner housing 16, drives the tubular shaft 32 on which is mounted a sprinkler head 34. The drive train is of the type illustrated in a number of patents such as that mentioned above and assigned to the assignee hereof. A tubular shaft 32 is rotatably mounted in the inner housing and forms a central passage way 36 which communicates with a passage 38 in a sprinkler head 34 and with an outlet opening 40 extending outward at an angle to the vertical rotary axis of the sprinkler head. Water flowing through the housing turns the turbine blade driving the sprinkler head about the axis of the housing.

In accordance with the invention, the sprinkler head 34 is provided with a nozzle or orifice plate 42 which is rotatably mounted within a slot 44 which intercepts passage 38 at right angles to the axis thereof. The nozzle plate or disc 42 is preferably circular or disc-like in configuration, as shown in FIG. 2 and is rotatably mounted within the slot 44 in head 34 by means of a suitable shaft or pin 46 and a circular bore 48 in the center of the shaft.

Figure 2:
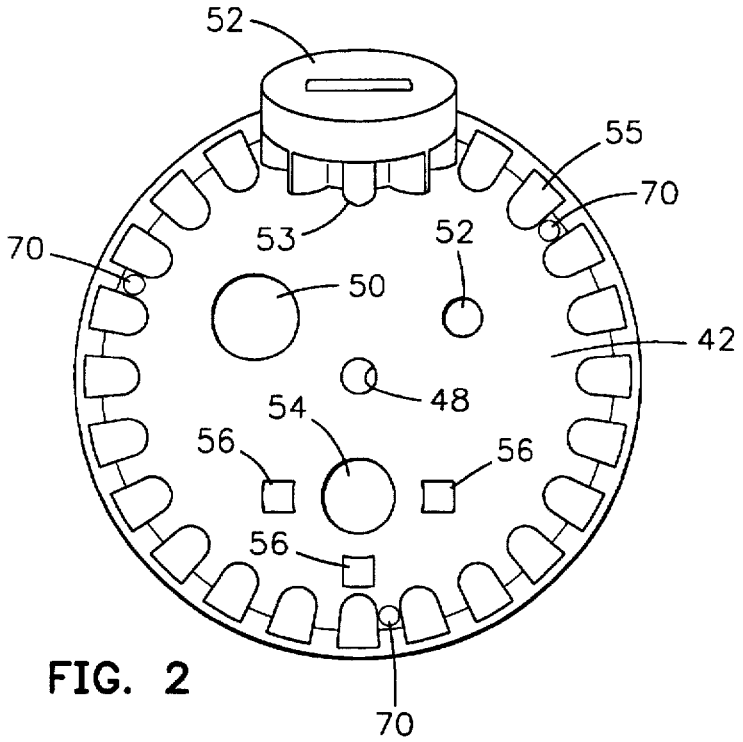
FIG. 2 is a front elevation view of the nozzle disc of the embodiment of FIG. 1.
Figure 3:
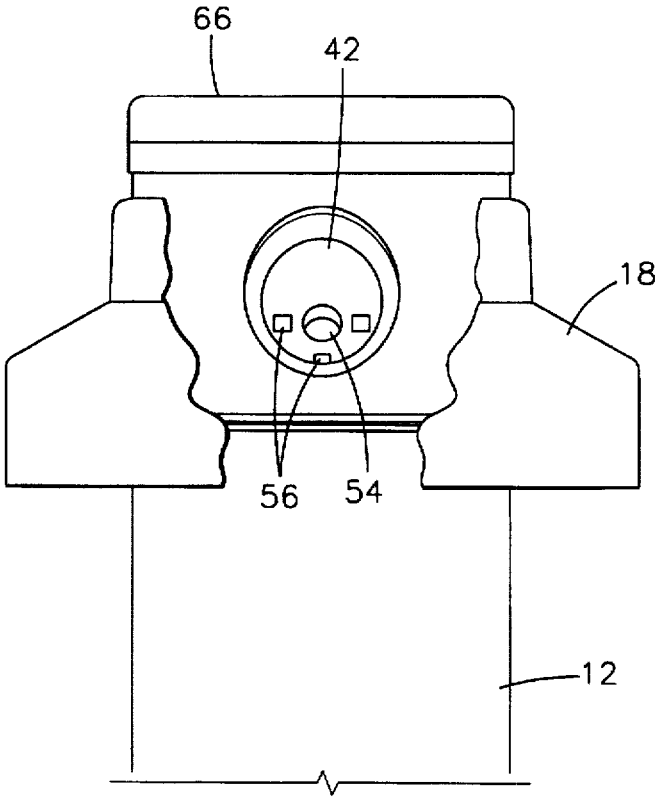
FIG. 3 is a view taken on line 3—3 of FIG. 1 with portions broken away to reveal details.

The nozzle plate as shown in FIG. 2 may be provided with any number of nozzles or orifices 50, 52 and 54 disposed about its center axis. These orifices or nozzles may have any number of configurations and may be accompanied by secondary nozzles, as in the case of orifice 54. As illustrated, three secondary smaller nozzles 56 are disposed in an array around the primary nozzle 54. An arrangement such as this provides a different pattern of coverage than a single nozzle. Thus, various arrays and configurations of nozzles may be formed in the nozzle disc to obtain a wide variety of spray patterns and volumes of distributions.

Various means may be provided for rotating the disc 42 to position a selected nozzle in the passage 38. An exemplary embodiment, as best illustrated in FIG. 2, includes a gear drive arrangement wherein a rotating pinion gear 51 has teeth 53 meshing with teeth 55 on the disc 42. The gear 51 is rotatably mounted by means of a shaft 57 in a bore 58 and by an outer cylindrical surface 60 of the gear journaled in a bore 62 in the head 34. The pinion gear 51 further includes a tool socket such as a slot 64 for a suitable tool such as a screwdriver, or the like. The gear 51 is disposed at the top of the sprinkler head and covered by a suitable flat elastic cover 66 with an opening 68 to provide access to the tool slot 64 in the pinion.

The disc 42 is preferably provided with detent means, such as a plurality of small recesses 70 disposed at a predetermined relationship with each of the orifices or nozzles 50–54 for receipt of a bump or protrusion 72 in the head 34 for retaining the disc in a selected rotational position or orientation. A suitable o-ring seal 74 is mounted within an annular recess or groove in a portion of the head 34 surrounding the passage 38 for sealing the disc 42 in position.

A shaft 76 is mounted in a bore 78 in the head 34 and has a tool receiving slot 80 at its upper end. This shaft is provided with a gear or gear teeth 82 at its lower end for meshing with an annular gear 84 for selectively adjusting arc and/or orientation of the head 34.

Figure 4:
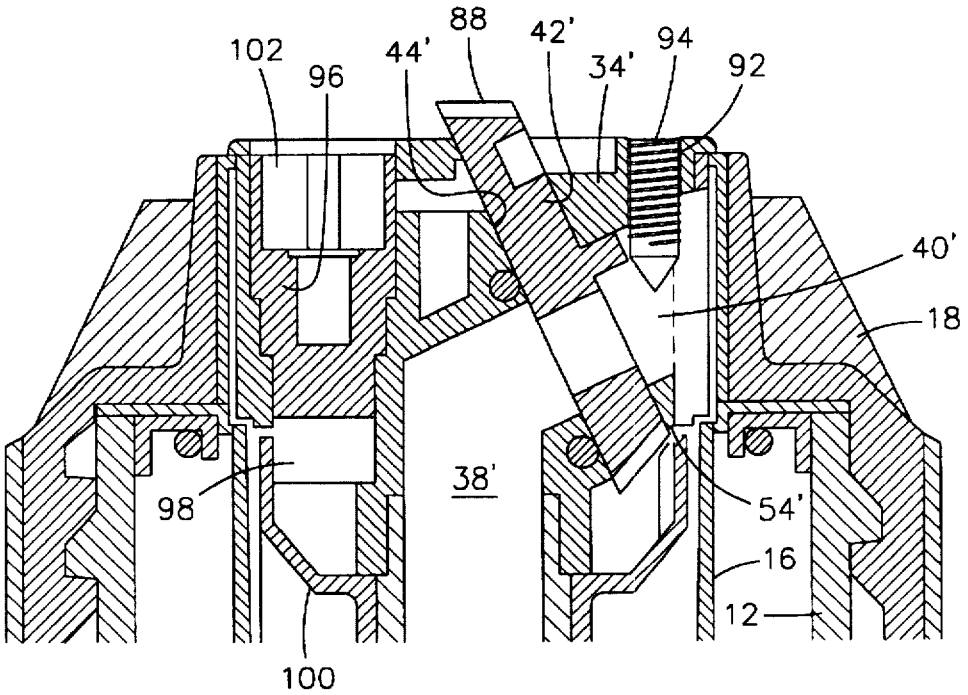
FIG. 4 is a side elevation view like FIG. 1 of an alternate embodiment of the invention.
Figure 5:
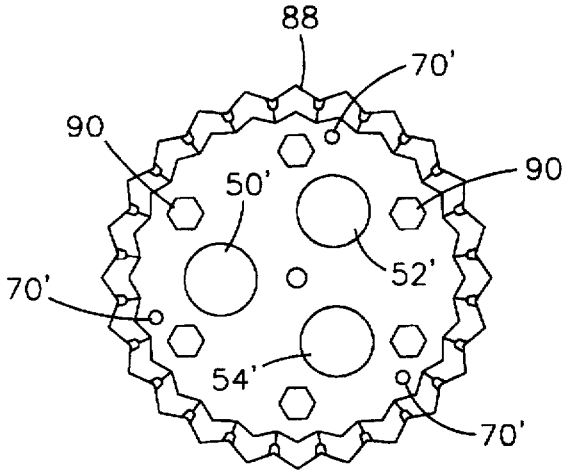
FIG. 5 is a front elevation view of the nozzle disc of the embodiment of FIG. 4.
Figure 6:
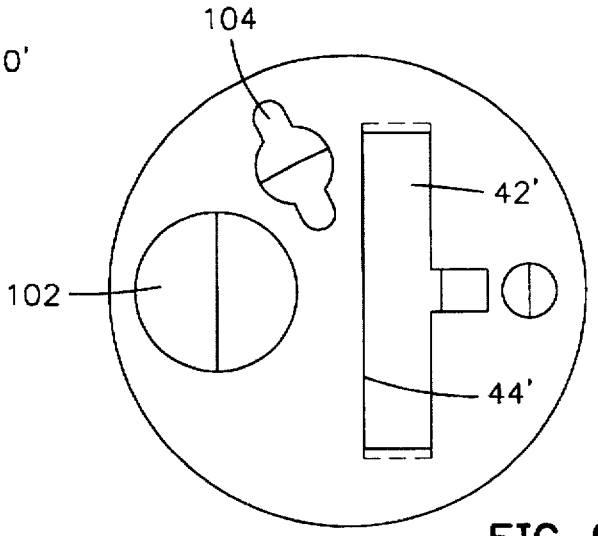
FIG. 6 is a top view of the embodiment of FIG. 4.

Referring to FIG. 4 of the drawing, an alternate embodiment of the invention is illustrated wherein like numbers will identify the same elements and like numbers primed will identify equivalent elements. In this embodiment a head 34' is mounted and driven as in the previous embodiment. The head has an equivalent passage 38' and outlet 40'. A slot 44' in the head intercepts the passage 38' as in the prior embodiment and mounts a rotating nozzle disc 42' as in the prior embodiment. In this embodiment, however, the nozzle disc 42' itself extends above the top of the head 34' and includes ridges or grooves 88 along the peripheral surface thereof to enable rotation of the disc. This surface of the disc can be engaged by a thumb or finger and rotated.

The disc 42' as in the prior embodiment is provided with multiple orifices or nozzles 50', 52', and 54' each of which may have a different reach volume or pattern. The disc is also provided with detent means including recesses 70' as in the previous embodiment. The disc is also provided in its face with a plurality of tool receiving recesses 90 which are in the form of sockets for receiving Alan wrenches or the like. This enables the use of a tool to rotate the disc 42'. These nozzles as in the previous embodiment may have any suitable configuration and may include multiple orifices as in the previous embodiment.

A screw 92 is threatably mounted in a bore 94 in the head and selectively or adjustably extends into the outlet passage and in the path of water exiting from orifice 54 to break up the stream. The screw can be adjusted to adjust the degree of breakup of the water stream and control coverage.

A rotatable shaft 96 includes gear teeth 98 for meshing with gear teeth on a annular gear 100 for adjusting the arc and/or orientation of the nozzle outlet. The shaft 92 includes a suitable tool receptacle 102 at the upper end and opening to the top of the head for easy access, as in the previous embodiment An opening or recess 104 is also provided in the head for receiving a key-like tool for engaging and pulling the unit up when it is not pressurized.

This nozzle system enables the easy selection of a nozzle to achieve a desired precipitation rate and range or reach of coverage. The nozzle discs are removable and replaceable from the top of the sprinkler head. The two important parameters necessary for the installer in choosing nozzles are the arc and the spacing range required for each sprinkler. In order to distribute water evenly when sprinklers have the same run time and different arcs, the nozzle disc is rotated to select the proper nozzle. The nozzles may be coded in a suitable manner such as by color or other indicia visible from above the sprinkler unit. The coding may indicate any one or more of a number of different parameters.

These sprinkler units, as pointed out above, permit the easy and economical installation of sprinkler systems for various plots of ground with minimal valving and controlling units and piping. For example, various shaped lawn areas can be laid out with a sprinkler system of the present invention with minimal complexity and with substantially uniform coverage. Each sprinkler unit gives the installer a simple and easy selection of the desired nozzle.

While we have illustrated and described our invention by means of specific embodiments, it should be understood that numerous changes and modifications may be made therein without departing from the spirit and scope of the invention as defined in the appended claims:

I claim:

1. A sprinkler unit having a system of nozzles for a wide range of conditions, the sprinkler unit comprising:

a housing having an inlet and an outlet and a passage connecting said inlet to said outlet, a slot intersecting said outlet and means for connecting said inlet to a source of water, a nozzle disc having a plurality of nozzles positioned about a central axis therein rotatably mounted in said slot at said outlet for selectively positioning a selected one of said plurality of nozzles in alignment with said outlet for distributing a stream of water outward from said housing; and said nozzle disc having means extending to a top of said housing for selectively moving said nozzle disc to a selected position, wherein said means extending to a top of said housing comprises a gear rotatably mounted on said top of said housing and meshing with gear teeth on an edge of said disc.

2. A sprinkler system according to claim 1 wherein said gear on said top includes a slot for receiving a tool for rotating said gear.

3. A sprinkler system according to claim 2 wherein said sprinkler unit is a pop-up unit normally retractable into a housing.

4. A sprinkler system according to claim 3 wherein said nozzle disc includes a plurality of nozzles having a uniform precipitation rate for different arcs of coverage.

5. A sprinkler unit having a plurality of selectable nozzles for selecting a wide range of conditions, the sprinkler unit comprising:

a housing having an inlet and an outlet and a flow passage connecting said inlet to said outlet and means for connecting said inlet to a source of water:

a generally circular nozzle plate having a plurality of nozzles therein rotatable mounted at said outlet for selectively positioning a selected one of said plurality of nozzles in alignment with said outlet for distributing a stream of water outward from said housing; and a gear rotatably mounted at a top of said housing and meshing with gear teeth on an edge of said nozzle plate for selectively moving said nozzle plate to a selected position.

6. A sprinkler system according to claim 5 wherein:

said housing has a generally circular top with a disc receiving slot therein which intersects said outlet; and said nozzle plate is a disc mounted in said slot and extending over said outlet for positioning said nozzles in alignment with said outlet.

7. A sprinkler system according to claim 5 wherein said sprinkler unit is a pop-up unit normally retractable into a housing.

8. A sprinkler system according to claim 5 wherein said nozzle disc includes a plurality of nozzles having a uniform precipitation rate for different arcs of coverage.

9. A sprinkler unit having a system of nozzles for a wide range of conditions, the sprinkler unit comprising:

a generally cylindrical housing having an axis and an inlet coaxial therewith and an outlet at an angle to the axis at a top thereof, a passage having an inlet portion extending along said axis from said inlet and an outlet portion extending at an angle to said axis to said outlet connecting said inlet to said outlet a slot intersecting said outlet portion of said passage adjacent to said outlet and means for connecting said inlet to a source of water;

a circular nozzle plate having a plurality of nozzles therein rotatably mounted in said slot adjacent to said outlet for selectively positioning a selected one of said plurality of nozzles in alignment with said outlet for distributing a stream of water outward from said housing; and means adjustable from the top of said housing for selectively moving said nozzle plate to a selected position.

10. A sprinkler system according to claim 9 wherein said selectively moving means engages an edge of said nozzle plate.

11. A sprinkler system according to claim 10 wherein said selectively moving means includes a gear mounted on said top of said housing and having a first plurality of teeth meshing with a second plurality of teeth on an edge of said nozzle plate.

12. A sprinkler system according to claim 11 wherein said nozzle plate includes a plurality of nozzles having a uniform precipitation rate for different arcs of coverage.

13. A sprinkler system according to claim 9 wherein said nozzle plate includes a plurality of nozzles having a uniform precipitation rate for different arcs of coverage.

14. A sprinkler system according to claim 13 wherein said nozzle plate extends to said top of said housing.

15. A sprinkler unit, comprising:

a generally tubular fixed outer housing having an inlet for connection to a riser;

a generally tubular inner housing telescopically mounted within the fixed outer housing;

a sprinkler head mounted on an upper end of the inner housing;

turbine means mounted in the inner housing for driving the sprinkler head about a central axis;

means defining a water passage through the sprinkler head terminating in an outlet; and adjustable nozzle means mounted inside the sprinkler head for intercepting the water passage with a selected one of a plurality of differently configured outlet orifices.

16. A sprinkler unit, comprising:

tubular housing means normally oriented with a central axis thereof in a vertical position and having a lower inlet end adapted for connection to a riser for receiving water from a pressurized source;

a sprinkler head mounted in an upper outlet end of the tubular housing means defining a passage for conveying water from the housing means to an outlet opening for discharge over a surrounding land area;

turbine means mounted in the tubular housing means for rotating the sprinkler head about the central axis over an adjustable arc; and multiple orifice nozzle means mounted inside the sprinkler head for intercepting the passage with a selected one of a plurality of differently configured outlet orifices to provide a uniform precipitation rate for different arcs of coverage.

* * * * *